United States Patent [19]

Grellmann et al.

[11] Patent Number: 4,721,481

[45] Date of Patent: Jan. 26, 1988

[54] REPLACEABLE RF CONNECTOR

[75] Inventors: H. Erwin Grellmann; Gerald K. Hein, both of Beaverton; Brian A. Ohlemeier; Randy C. Karambelas, both of Aloha, all of Oreg.

[73] Assignee: Tektronix, Inc., Beaverton, Oreg.

[21] Appl. No.: 872,343

[22] Filed: Jun. 9, 1986

[51] Int. Cl.[4] ..... H01R 17/18

[52] U.S. Cl. ..... 439/581; 439/621; 439/551

[58] Field of Search ..... 239/177, 88 C, 89 C, 239/90 C, 126 R, 126 J, 126 RS, 147 R, 147 P, 14 R, 14 P

[56] References Cited

U.S. PATENT DOCUMENTS

| | | | |
|---|---|---|---|
| 2,762,025 | 9/1956 | Melcher | 339/177 R |
| 3,783,321 | 1/1974 | Patterson | 339/14 R |
| 3,904,264 | 9/1975 | Oertle | 339/177 R |
| 4,199,736 | 4/1980 | McTaggert et al. | 339/126 J |
| 4,591,216 | 5/1986 | McClune | 339/126 J |

FOREIGN PATENT DOCUMENTS

| | | | |
|---|---|---|---|
| 3230473 | 2/1984 | Fed. Rep. of Germany | 339/126 J |

*Primary Examiner*—Gil Weidenfeld
*Assistant Examiner*—David Pirlot
*Attorney, Agent, or Firm*—Francis I. Gray

[57] ABSTRACT

A replaceable RF connector with replaceable fuse has a receptacle mounted on a housing, the receptacle having a cavity and a throughole to the interior of the housing. An RF connector has a connector end for connecting cables and/or adaptors, a receptacle end having a fuse cavity in electrical connection with the connector end, and a flange integral between the connector end and the receptacle end. The receptacle end is configured to slide into the receptacle cavity such that a fuse electrically mounted in the fuse cavity has a lead extending through the receptacle throughole for connection to a circuit internal to the housing. A retainer ring slips over the RF connector such that the connector end protrudes, and is attached to the receptacle such that the RF connector is secured in the receptacle by the flange.

4 Claims, 4 Drawing Figures

REPLACEABLE RF CONNECTOR

BACKGROUND OF THE INVENTION

The present invention relates to RF connectors, and more particularly to a replaceable RF connector which will not become inadvertently disconnected when external cables and/or adaptors are disconnected, and which is adapted to allow front replacement of a fuse.

As shown in FIG. 1 prior RF connectors adapted for replaceable fuses, such as the Model 486-001 manufactured by Cablewave Miniature Products of Wallingford, Conn., screwed into a receptacle, or housing, with the fuse electrically connected between the receptacle and the RF connector. When a cable or adaptor is screwed on the end of the RF connector, subsequent removal of the cable or adaptor often resulted in removal of the RF connector unless the connector is torqued down with a wrench so that it takes more force to unscrew the RF connector than it does to unscrew the cable or adaptor. This presents a decided inconvenience to the operator of the instrument to which the RF connector is attached. Further, since the RF connector screws into an interior threaded hole and has a smaller diameter, the RF connector presents an inherently mechanically weaker structure at the connection point.

What is desired is a replaceable RF connector adaptable for a replaceable fuse which cannot be removed when a cable or adaptor attached thereto is removed, and which maintains a mechanically strong structure at the connection point.

SUMMARY OF THE INVENTION

Accordingly the present invention provides a replaceable RF connector adaptable for a replaceable fuse having a receptacle end which slides into a matching cavity in a receptacle or housing. A flange on the RF connector provides a bearing surface for a retaining ring, and the retaining ring screws onto the receptacle or housing and secures the RF connector to the receptacle or housing. The receptacle end of the RF connector mates with the receptacle or housing surface to provide a continuous RF ground path. One end of a fuse is electrically inserted into a socket within a fuse cavity in the receptacle end of the RF connector, and the other end extends through a hole in the receptacle or housing for connection to an interior circuit.

The objects, advantages and novel features of the present invention will be apparent from the following detailed description when read in conjunction with the appended claims and attached drawing.

DESCRIPTION OF THE PREFERRED EMBODIMENT

Figure 3:
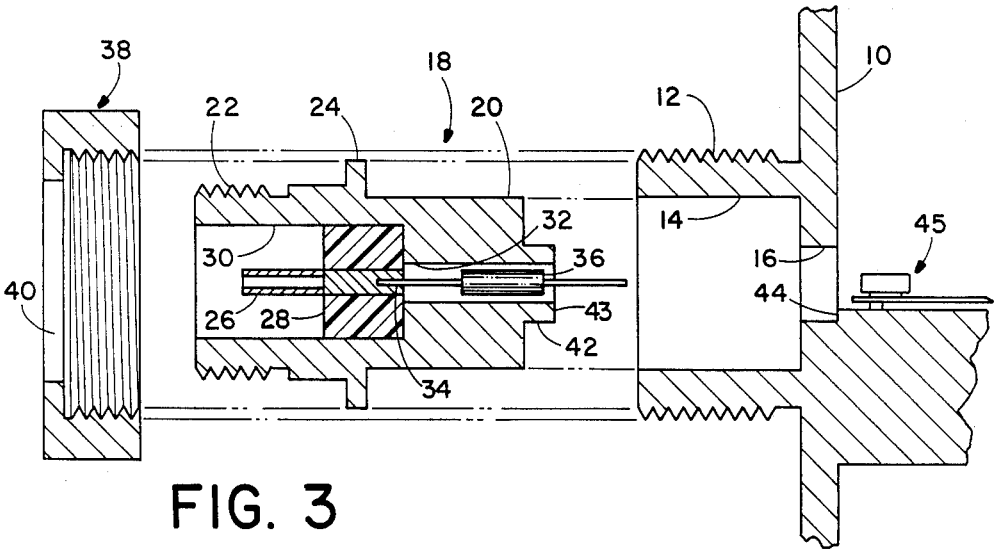
FIG. 3 is a cross-sectional view of the RF connector of FIG. 2.
Figure 2:
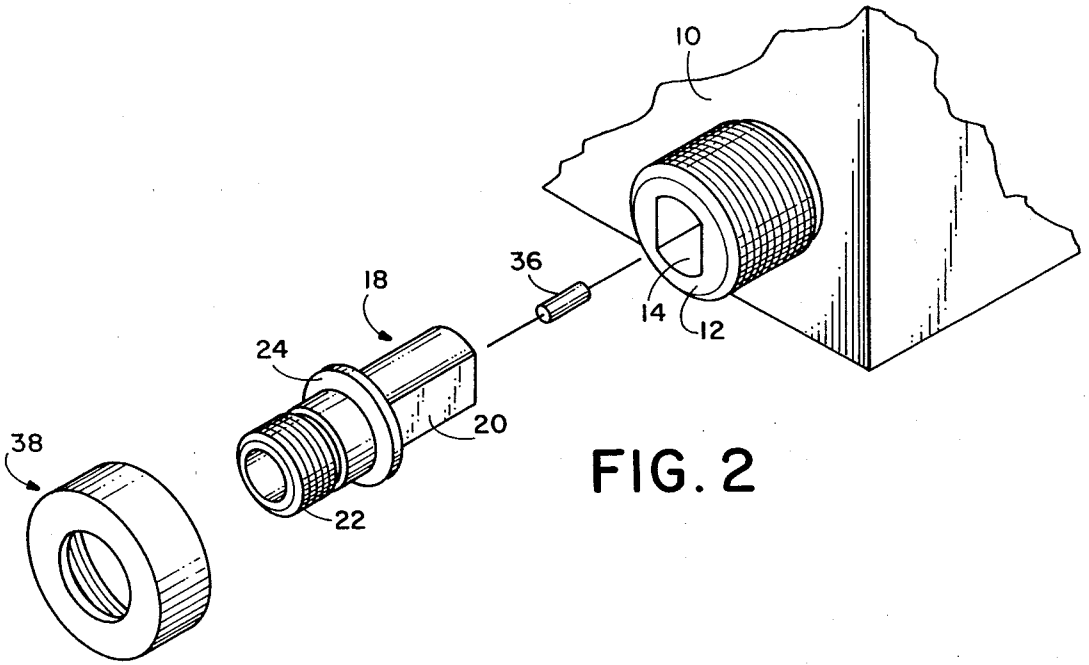
FIG. 2 is an exploded, perspective view of a replaceable RF connector with a replaceable fuse according to the present invention

Referring now to FIGS. 2 and 3 a housing 10 is shown with an integral receptacle 12 having a cavity 14 and a throughhole 16. An RF connector 18 according to the present invention has a receptacle end 20, a connector end 22 and a flange 24 integral with and separating the ends. The connector end 22 is a standard type RF connector, such as a Type N, SMA, BNC or the like, having a central conductor 26 embedded in an insulator 28, such as Teflon, recessed in a cavity 30. The receptacle end 20 has a fuse cavity 32 which is impedance compensated and which extends from the receptacle end of the central conductor 26. The receptacle end of the central conductor 26 has a socket 34 to receive an electrical lead of a fuse 36. A retaining ring 38 has interior threads to mate with exterior threads of the receptacle 12. A throughhole 40 in the retaining ring 38 allows the connector end 22 of the RF connector 18 to protrude through, but is smaller in diameter than the RF connector flange 24. The shape of the receptacle end 20 and the cavity 14 are similar such that, when the receptacle end is inserted into the cavity, the RF connector 18 cannot rotate. The retaining ring 38 serves to mechanically secure the RF connector 18 to the receptacle 12 by compressing the RF connector 18 between the retaining ring and the receptacle at mating surfaces 43 and 44 as the retaining ring is tightened against the flange 24.

Figure 1:
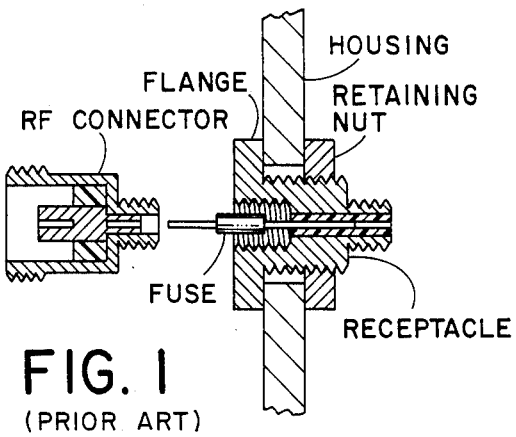
FIG. 1 (PRIOR ART)
FIG. 1 is a cross-sectional view of a prior art RF connector with a replaceable fuse.
Figure 4:
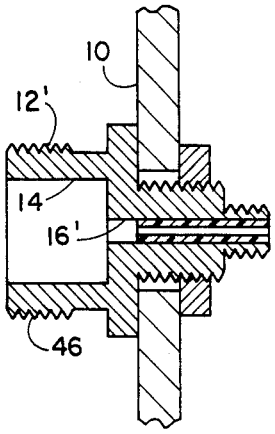
FIG. 4 is an alternate embodiment wherein the receptacle of FIG. 2 is separable from the housing.

Alternatively the receptacle 12 of FIGS. 2 and 3, which is an integral part of the housing 10, may be replaced by a separate receptacle 12′ as shown in FIG. 4 which extends through a hole in the housing 10. This receptacle 12′ is similar to that shown in FIG. 1 except the interior threaded cavity is replaced with a cavity 14 like that of FIGS. 2 and 3, and external threads 46 are provided for mating with the retaining ring 38.

In operation the fuse 36 is inserted into the fuse cavity 32 of the RF connector 18 such that one fuse lead is captured by the socket 34 at the end of the central conductor 26. The RF connector 18 is then slid into the receptacle cavity 14 such that a smaller diameter extension 42 of the connector fits into the receptacle throughhole 16 with the other fuse lead extending into the interior of the housing 10 to make electrical connection with an interior circuit. The retaining ring 38 is then slid over the connector end 22 of the RF connector 18 and screwed onto the receptacle 12, securing the RF connector firmly in place. Now cables or adaptors can be screwed onto the connector end 22 and easily removed when desired without affecting the RF connector. Further since the size of the RF connector 18 at the receptacle 12 is not significantly diminished, the RF connector has inherently greater structural strength at the connection point.

Thus the present invention provides a replaceable RF connector adaptable for a replaceable fuse which is not affected by the removal of cables and adaptors and which is not mechanically weakened at the point of connection to a receptacle by having a cavity in the receptacle into which the RF connector slides. The RF connector is then maintained in place by a retaining ring.

What is claimed is:

1. A replaceable RF connector comprising:

a receptacle mounted on a housing, the receptacle having a cavity with a non-cylindrical shape having a throughhole extending between the cavity and the interior of the housing;

an RF connector having a connector end, a receptacle end shaped to conform closely to the shape of the receptacle cavity so that rotation of the RF connector within the receptacle cavity is prevented, the receptacle end having an impedance compensated fuse cavity, and a flange integral between the connector end and the receptacle end;

means for retaining the receptacle end of the RF connector in the receptacle cavity; and a replaceable fuse which fits within the impedance compensated fuse cavity and is electrically connected at one end to a central conductor within the RF connector, the other end extending from the impedance compensated fuse cavity through the throughhole so that when the RF connector is attached to the receptacle by the retaining means the other end of the replaceable fuse is electrically connected to an electrical circuit within the housing.

2. A replaceable RF connector as recited in claim 1 wherein the retaining means comprises a retaining ring having internal threads for screwing onto matching external threads on the receptacle, and having a central throughhole such that, when the retaining ring is attached to the receptacle, the connector end protrudes while the flange is retained between the retaining ring and the receptacle with the receptacle end in the receptacle cavity electrically connected to the electrical circuit and constrained from rotational movement.

3. A replaceable RF connector as recited in claim 1 wherein the receptacle end further comprises a smaller diameter extension which fits within the throughhole extending interior to the housing when the receptacle end is secured within the receptacle cavity.

4. A replaceable RF connector as recited in claim 1 wherein the receptacle is an integral part of the housing.

* * * * *